US010647014B2

(12) United States Patent
Khan et al.

(10) Patent No.: US 10,647,014 B2
(45) Date of Patent: May 12, 2020

(54) CUTTING OF LARGE POTATOES

(71) Applicant: Frito-Lay Trading Company Gmbh, Berne (CH)

(72) Inventors: Ahmed Nadim Khan, Staffordshire (GB); Neal Lingard, Leicester (GB)

(73) Assignee: Frito-Lay Trading Company GmbH, Berne (CH)

( * ) Notice: Subject to any disclaimer, the term of this patent is extended or adjusted under 35 U.S.C. 154(b) by 245 days.

(21) Appl. No.: 15/314,910

(22) PCT Filed: May 28, 2015

(86) PCT No.: PCT/EP2015/061799

§ 371 (c)(1),
(2) Date: Nov. 29, 2016

(87) PCT Pub. No.: WO2015/181273

PCT Pub. Date: Dec. 3, 2015

(65) Prior Publication Data

US 2017/0239831 A1 Aug. 24, 2017

(30) Foreign Application Priority Data

May 29, 2014 (GB) ..... 1409546.7
Feb. 27, 2015 (GB) ..... 1503397.0

(51) Int. Cl.
*B26D 7/06* (2006.01)
*B26D 1/03* (2006.01)
(Continued)

(52) U.S. Cl.
CPC ..... *B26D 7/0691* (2013.01); *B26D 1/03* (2013.01); *B26D 1/36* (2013.01); *B26D 3/18* (2013.01);
(Continued)

(58) Field of Classification Search
CPC ..... B26D 7/0691; B26D 1/03; B26D 1/36; B26D 7/2614; Y10T 83/6473; Y10T 83/6492
(Continued)

(56) References Cited

U.S. PATENT DOCUMENTS 2,195,879 A * 4/1940 Urschel ..... B26D 1/03 83/403
4,391,172 A * 7/1983 Galland ..... B26D 1/02 83/403
(Continued)

FOREIGN PATENT DOCUMENTS

DE 102015213139 A1 1/2017
GB 826166 12/1959
(Continued)

OTHER PUBLICATIONS

Office Action dated Jan. 31, 2020 in Mexican Application No. MX/a/2016/014981 with accompanying English language machine translation.

*Primary Examiner* — Laura M Lee
(74) *Attorney, Agent, or Firm* — G. Peter Nichols; Barnes & Thornburg LP

(57) ABSTRACT

An apparatus for cutting potato slices, the apparatus comprising an annular-shaped cutting head and a central impeller coaxially mounted for rotation within the cutting head for delivering potatoes radially outwardly toward the cutting head, a plurality of knives serially mounted annularly around the cutting head, and a plurality of orientation elements serially and annularly mounted within the impeller to define a plurality of cutting zones located around the impeller, each cutting zone being between adjacent orientation elements, wherein radially inner parts of adjacent orientation elements are separated in circumferential direction to define between adjacent orientation elements a throat
(Continued)

for passage therethrough of a potato in a radially outward direction into the respective cutting zone toward the cutting head, wherein the throat has a width of from 70 to 140 mm.

22 Claims, 11 Drawing Sheets

(51) Int. Cl.

| | |
|---|---|
| ***B26D 1/36*** | (2006.01) |
| ***B26D 3/18*** | (2006.01) |
| ***B26D 7/26*** | (2006.01) |
| *B26D 1/02* | (2006.01) |
| *B26D 3/26* | (2006.01) |

(52) U.S. Cl.
CPC ..... *B26D 7/2614* (2013.01); *B26D 7/2628* (2013.01); *B26D 1/02* (2013.01); *B26D 3/26* (2013.01); *B26D 2210/02* (2013.01); *Y10T 83/6473* (2015.04); *Y10T 83/6492* (2015.04)

(58) Field of Classification Search
USPC ..... 83/403
See application file for complete search history.

(56) References Cited

U.S. PATENT DOCUMENTS

| | | | | |
|---|---|---|---|---|
| 4,625,606 | A | 12/1986 | Pinegar et al. | |
| 6,883,411 | B2 * | 4/2005 | Arrasmith | B26D 1/02 416/187 |
| 8,161,856 | B2 * | 4/2012 | Jacko | B26D 1/03 83/403 |
| 9,855,668 | B2 * | 1/2018 | Bucks | B26D 5/00 |
| 2009/0202694 | A1 | 8/2009 | Julian et al. | |
| 2014/0007751 | A1 * | 1/2014 | Michel | B26D 7/0691 83/403 |
| 2014/0230621 | A1 | 8/2014 | Bucks | |
| 2016/0075047 | A1 | 3/2016 | Bucks | |

FOREIGN PATENT DOCUMENTS

| | | | |
|---|---|---|---|
| GB | 2172185 | A | 9/1986 |
| JP | 2003285294 | A | 10/2003 |

* cited by examiner

Comparative Example 1

Example 4

CUTTING OF LARGE POTATOES

BACKGROUND TO THE INVENTION

The present invention relates to an apparatus for cutting potato slices and to a method of producing potato slices for the manufacture of potato chips.

Description of the Prior Art

It is well known to employ a rotary cutting apparatus for cutting potatoes into fine slices for the manufacture of potato chips. A well-known cutting apparatus, which has been used for more than 50 years, comprises an annular-shaped cutting head and a central impeller assembly coaxially mounted for rotation within the cutting head to deliver food products, such as potatoes, radially outwardly toward the cutting head.

A series of knives is mounted annularly around the cutting head and the knife cutting edges extend substantially circumferentially but slightly radially inwardly towards the impeller assembly. Each knife blade is clamped to the cutting head to provide a gap, extending in a radial direction, between the cutting edge of the blade and the head. The gap defines the thickness of the potato slices formed by the cutter.

In the manufacture of potato chips, the potatoes are cut into slices and, after cooking, for example by frying, and seasoning potato chips are produced which then are packaged for the consumer.

One problem with current manufacturing methods and apparatus is that sometimes a small proportion of the potato chips have a maximum width dimension which is higher than a desired threshold with the result that that the potato chips can be difficult to package. Typically, a measured amount of the potato chips is filled into a package which comprises a flexible bag, of selected dimensions, for packaging a defined weight of the potato chips. The bag is filled by, for example, a known vertical form, fill and seal (VFFS) machine. During the filling step, the package has an upper opening presenting a maximum width dimension, most typically a diameter of the opening, through which the potato chips are filled downwardly into the bag under gravity.

If the potato chips are too large in dimension, it is difficult to fill the bag reliably and at high speed. Intermittently, some of the potato chips may inadvertently become tapped in the upper seal of the bag, which compromises product quality. In some cases, up to about 0.5% of the packages can be wasted because of this phenomenon. In addition, consumers may purchase faulty packaged products, which may lead to undesired consumer complaints.

Lowering the packaging speed lowers productivity and is undesirable.

There is a general desire in the art to reduce packaging material costs, for example by reducing the amount of film used to produce a bag, but it is difficult to achieve a reduction in film consumption if the potato chips are too large for the specific bag size.

Furthermore, large potato slices can reduce the ability of a given weight of potato chips to pack together in a package. This can require the packaging line speed to be reduced, which increases the production costs and lowers the production efficiency. Additionally, the package volume needs to be enlarged to be able to accommodate the poor chip packing density.

In order to attempt to alleviate the problems of excessively large potato chips, it is known to use grade potatoes prior to processing in order to ensure that the potatoes are sufficiently small that these packaging problems are minimized. The grading may be manual or automated. However, the use of small potatoes reduces the productivity and efficiency of the potato chip manufacturing process. Also, the production line cost is increased.

In addition, there is an increasing desire to use large potatoes to manufacture potato chips in order to increase the productivity and efficiency of the potato chip manufacturing process. Large potatoes are agronomically more productive with a higher yield per acre of crops. There are some potato varieties which are used to manufacture other potato products, such as French fries, but which cannot efficiently be used to manufacture potato chips using known potato chip manufacturing apparatus and processes because the potatoes are too large.

If potatoes are used which are too large for the cutting head to process, it is known to use a "grader halver" upstream of the potato slicer. The grader halver cuts the potatoes in half prior to slicing in order to reduce the slice dimensions. There are a number of problems with the use of potato halvers. First, the production line cost is increased. Second, the grader halvers are not very efficient and can reduce production speeds. Third, the presence of potato chips with straight edges in a package of potato chips is generally not acceptable to the consumer.

It is also known to use packaging machines with "chip breakers" which remove or break up excessively large potato chips immediately upstream of the packaging machine. However, this causes product waste and/or can also produce a large number of crumbs or small pieces which again are generally not acceptable to the consumer.

There is a need in the art to be able to use large potatoes for the manufacture of potato chips which can avoid at least some and preferably all of the problems of the prior at as discussed above.

SUMMARY OF THE INVENTION

The present invention aims at least partially to overcome at least some of these problems of the known methods and apparatus for manufacturing potato slices and potato chips made therefrom.

Accordingly, the present invention provides an apparatus for cutting potato slices, the apparatus comprising an annular-shaped cutting head and a central impeller coaxially mounted for rotation within the cutting head for delivering potatoes radially outwardly toward the cutting head, the impeller having a base with an upper surface across which potatoes are, in use, delivered to the cutting head, a plurality of knives serially mounted annularly around the cutting head, each knife having a cutting edge extending substantially upwardly and spaced from the cutting head to provide a gap, extending in a radial direction, between the cutting edge and the cutting head, and a plurality of orientation elements serially and annularly mounted within the impeller to define a plurality of cutting zones located around the impeller, each cutting zone being between adjacent orientation elements, wherein radially inner parts of adjacent orientation elements are separated in a substantially circumferential direction to define between adjacent orientation elements a throat for passage therethrough of a potato in a radially outward direction into the respective cutting zone toward the cutting head, wherein the throat has a width of from 70 to 140 mm.

The present invention further provides a method of producing potato slices for the manufacture of potato chips, the method comprising the steps of:

a. providing a plurality of potatoes, at least some of which are elongate along a longitudinal direction, wherein at least some of the elongate potatoes have a longitudinal length which is within the range of from 70 to 250 mm;

b. providing a cutting apparatus comprising an annular-shaped cutting head and a central impeller coaxially mounted within the cutting head for delivering potatoes radially outwardly toward the cutting head, a plurality of knives serially mounted annularly around the cutting head, each knife having a cutting edge extending substantially upwardly and spaced from the cutting head to provide a gap, extending in a radial direction, between the cutting edge and the cutting head, and a plurality of orientation elements serially and annularly mounted within the impeller to define a plurality of cutting zones located around the impeller, each cutting zone being between adjacent orientation elements, wherein radially inner parts of adjacent orientation elements are separated in a substantially circumferential direction to define between adjacent orientation elements a throat for passage therethrough of a potato in a radially outward direction into the respective cutting zone toward the cutting head, wherein the throat has a width of from 70 to 140 mm;

c. feeding the potatoes into the impeller, the impeller rotating to deliver the potatoes radially outwardly toward the cutting head by a centrifugal force into the cutting zones;

d. for at least some of the elongate potatoes, deflecting a rotationally leading part of the outwardly moving elongate potato within the impeller in a rotationally rearward and inward direction by a potato deflection surface of a respective first orientation element, which potato deflection surface at least partly faces inwardly with respect to an outer periphery of the impeller, so as to orient the longitudinal direction of the elongate potato into a substantially radial orientation, in a cutting position, with the potato urged against a potato supporting surface of a second orientation element, the second orientation element being adjacent to and rotationally trailing the first orientation element; and e. cutting each potato in the cutting position into slices by the plurality of knives, centrifugal force radially outwardly advancing each potato in the cutting position prior to a subsequent slice cutting action.

The present invention further provides an apparatus for cutting potato slices, the apparatus comprising an annular-shaped cutting head and a central impeller coaxially mounted for rotation within the cutting head for delivering potatoes radially outwardly toward the cutting head, the impeller having a base with an upper surface across which potatoes are, in use, delivered to the cutting head, a plurality of knives serially mounted annularly around the cutting head, each knife having a cutting edge extending substantially upwardly and spaced from the cutting head to provide a gap, extending in a radial direction, between the cutting edge and the cutting head, and a plurality of orientation elements serially and annularly mounted within the impeller to define a plurality of cutting zones located around the impeller, each cutting zone being between adjacent orientation elements, each orientation element defining a potato deflection surface on a first side of the orientation element and a potato supporting surface on a second side of the orientation element, at least a part of each potato deflection surface extending in a direction having a first component in the circumferential direction and at least a second component in the radial direction so that the potato deflection surface at least partly faces inwardly with respect to an outer periphery of the impeller.

The present invention further provides a method of producing potato slices for the manufacture of potato chips, the method comprising the steps of:

a. providing a plurality of potatoes, at least some of which are elongate along a longitudinal direction;

b. providing a cutting apparatus comprising an annular-shaped cutting head and a central impeller coaxially mounted within the cutting head for delivering potatoes radially outwardly toward the cutting head, a plurality of knives serially mounted annularly around the cutting head, each knife having a cutting edge extending substantially upwardly and spaced from the cutting head to provide a gap, extending in a radial direction, between the cutting edge and the cutting head, and a plurality of orientation elements serially and annularly mounted within the impeller to define a plurality of cutting zones located around the impeller, each cutting zone being between adjacent orientation elements;

c. feeding the potatoes into the impeller, the impeller rotating to deliver the potatoes radially outwardly toward the cutting head by a centrifugal force into the cutting zones;

d. for at least some of the elongate potatoes, deflecting a rotationally leading part of the outwardly moving elongate potato within the impeller in a rotationally rearward and inward direction by a potato deflection surface of a respective first orientation element, which potato deflection surface at least partly faces inwardly with respect to an outer periphery of the impeller, so as to orient the longitudinal direction of the elongate potato into a substantially radial orientation, in a cutting position, with the potato urged against a potato supporting surface of a second orientation element, the second orientation element being adjacent to and rotationally trailing the first orientation element; and e. cutting each potato in the cutting position into slices by the plurality of knives, centrifugal force radially outwardly advancing each potato in the cutting position prior to a subsequent slice cutting action.

Preferred features of the apparatus and method of the present invention are defined in the dependent claims.

The preferred embodiments of the present invention provide a number of technical and commercial advantages and benefits over the known methods and apparatus for manufacturing potato slices and potato chips made therefrom.

First, the potato slices, and the resultant potato chips, have a statistically higher proportion which are substantially round in shape and within a size range having a desired maximum width dimension so that the potato chips are easier to package, particularly into flexible bags by use of a known vertical form, fill and seal (VFFS) machine. A more homogeneous population of substantially round slices and chips can be produced, even from very large, elongate potatoes. For example, even if the elongate potatoes have an initial maximum length of 200 mm, a very high proportion of the potato slices have a maximum width dimension of 95 mm. The bag can be filed reliably and at high speed. Packaging waste and consumer complaints can be reduced.

The packaging line speed can be high, which reduces the production costs and increases the production efficiency. There is very little additional capital cost or running cost by the introduction of the modified twin blade assembly used in the embodiments of the present invention.

Additionally, the package volume can be reduced for a given weight of product because of the increased chip packing density. Bag sizes and associated packaging material costs can be reduced.

Furthermore, the upstream grading of potatoes prior to processing can be reduced or eliminated. There is no need to use grader halvers. The production line capital and running costs can be reduced.

Also, large potatoes can be used to manufacture potato chips in order to increase the productivity and efficiency of the potato chip manufacturing process. Some potato varieties which have not hitherto been used commercially in large volumes to manufacture potato chips efficiently can now be used to manufacture potato chips.

By controlling the orientation of elongate potatoes in the cutting head, an effective and efficient apparatus and process are provided which allow large potatoes to be used while minimizing the proportion of potato chips with excessive maximum width in a package of potato chips.

Also, "chip breakers" can be avoided, and product waste and/or excessive crumbs or small pieces can be minimized.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENTS

Figure 1:
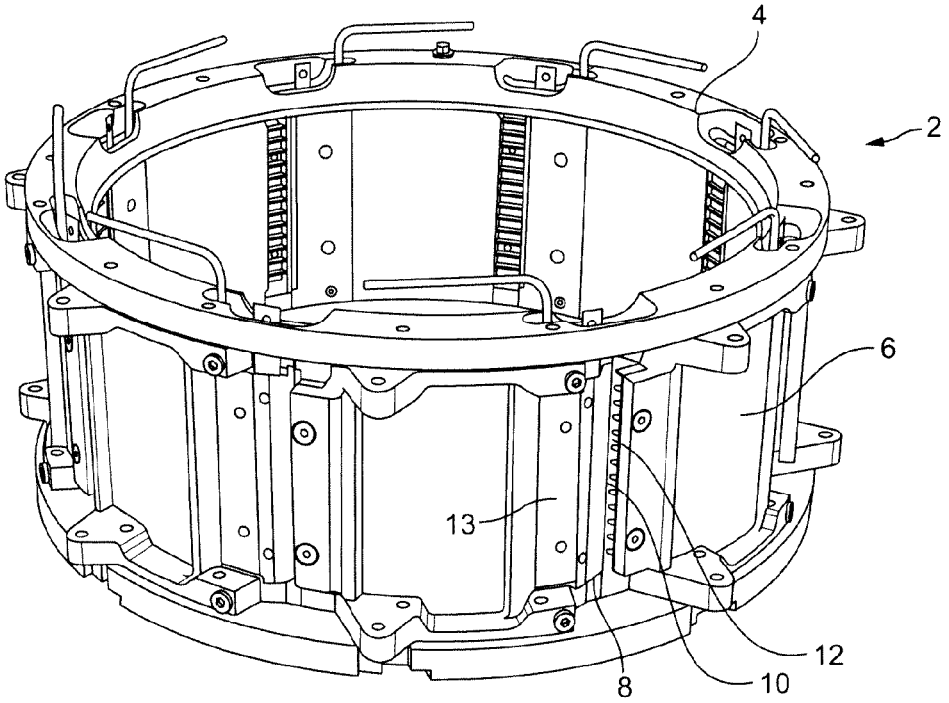
FIG. 1 is a schematic side perspective view of a cutting head of a potato slice cutting apparatus in accordance with the present invention.
Figure 2:
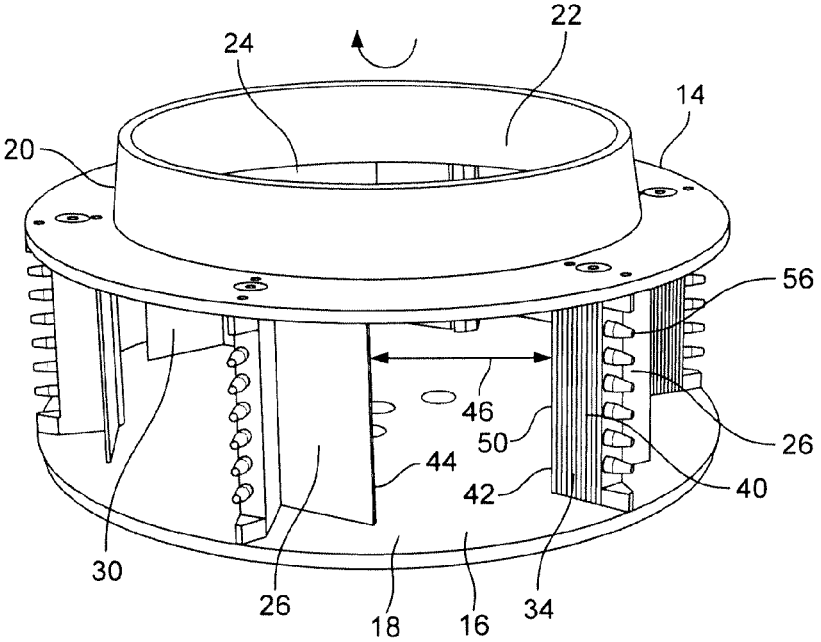
FIG. 2 is a schematic side perspective view of an impeller for mounting within the cutting head of FIG. 1 to provide a potato slice cutting apparatus in accordance with the a first embodiment of the present invention.
Figure 3:
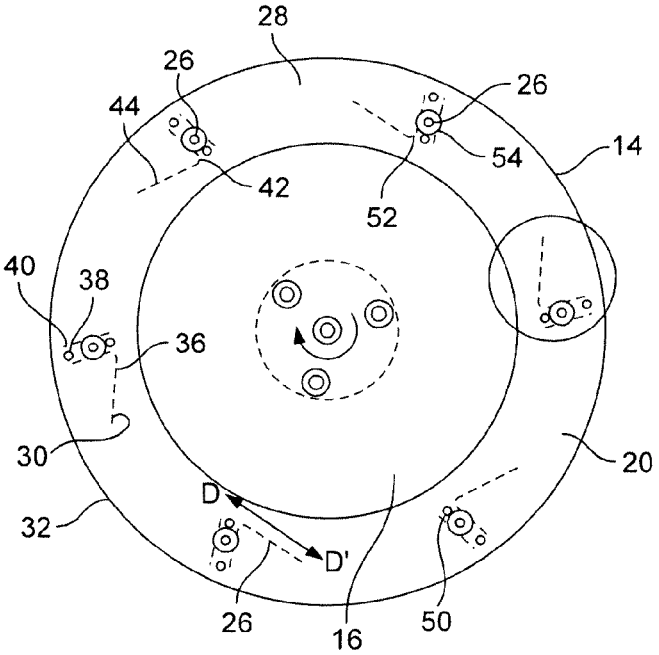
FIG. 3 is a plan view of the impeller of FIG. 2.

Referring to FIGS. 1 to 3, a potato slice cutting apparatus 2 in accordance with an embodiment of the present invention comprises an annular-shaped cutting head 4. The cutting head 4 includes a cylindrical wall 6 in which a plurality of knives 8 are serially mounted annularly around the cutting head 4. The knife cutting edges 10 extend substantially circumferentially but slightly radially inwardly. Each knife 8 has a cutting edge 10 extending substantially vertically upwardly. The cutting edge may be planar, to cut planar slices, or wavy, to cut crinkle-cut slices. Other knife configurations may be employed, as are known in the art. The cutting edges 10 extend substantially circumferentially but slightly radially inwardly. Each cutting edge 10 is spaced from the cutting head 4 to provide a respective gap 12, extending in a substantially radial direction, between the cutting edge 10 and the cutting head 4. The gap 12 defines a slice thickness to be cut by the potato chip cutting apparatus 2. The width of the gap 12 can be varied by readjusting the position of the knife 8 in a respective blade mount 13, which includes a knife clamp. Such a cutting head 4 is well known for use in the manufacture of potato slices for the manufacture of potato chips.

A central impeller 14, shown separately in FIGS. 2 and 3 but in use assembled together with the cutting head 4 of FIG. 1, is coaxially mounted for rotation within the cutting head 4 for delivering potatoes radially outwardly toward the cutting head 4. The impeller 14 has a base 16 with an upper surface 18 across which potatoes are, in use, delivered to the cutting head 4. A cover 20 having a potato supply opening 22 is fitted above the base 16. The impeller 14 is typically composed of stainless steel.

When the central impeller 14 and cutting head 4 are assembled together, the cylindrical wall 6, base 16 and cover 20 define a central cavity 24. In use, potatoes are supplied into the central cavity 24 through the potato supply opening 22. A typical potato supply rate is 2500 kg of potatoes per hour. The impeller 14 rotates to deliver the potatoes radially outwardly toward the cutting head 4 by a centrifugal force. Each potato is cut into a plurality of slices by the plurality of knives 8. The potato is cut by one knife 8 to cut off one slice as the potato rotates past that knife 8, and then the potato is rotated by the impeller 14 to the rotationally adjacent knife 8 and a subsequent slice is cut off by that knife 8. Centrifugal force radially outwardly advances each potato into a cutting position prior to a subsequent slice cutting action. Each potato is successively cut by the sequence of knives 8 as the potato rotates around the annular array of knives 8. This forms a plurality of slices from each potato.

A plurality of orientation elements 26, in this embodiment six orientation elements 26, are fitted between the base 16 and cover 20, and eight knives 8. These numbers can readily be independently varied. Optionally, the number of orientation elements 26 corresponds to the number of knives 8.

At least one part 34 of each orientation element 26 extends in a direction upwardly from the upper surface 18. The orientation elements 26 are serially and annularly mounted within the impeller 14 to define a plurality of cutting zones 28 located around the impeller 24. Each cutting zone 28 is between adjacent orientation elements 26. Each orientation element 26 includes a potato deflection surface 30 which extends in a direction D-D' having a first component in the circumferential direction and at least a second component in the radial direction so that the potato deflection surface 30 at least partly faces inwardly with respect to an outer circumferential periphery 32 of the impeller 14.

The potato deflection surface 30 is on a first side 36 of the orientation element 26 and a second side 38 of the orientation element 26 defines a potato supporting surface 40. The impeller 14 is adapted to rotate in a specific rotational direction, as shown by the arrows in FIGS. 2 and 3, and the first side 36 is a rotationally trailing side and the second side 40 is a rotationally leading side.

In this embodiment, the orientation elements 26 have the same shape and dimensions, and the orientation elements 26 are equally spaced around the impeller 14.

The potato deflection surface 30 extends between radially inner and radially outer parts 42, 44 of the respective orientation element 26. The radially inner part 42 of each orientation element 26 is separated in a substantially circumferential direction from the radially outer part 44 of an adjacent orientation element 26 to define a throat 46 for passage therethrough of a potato in a radially outward direction toward the cutting head 4. Typically, the throat 46 has a width of from 70 to 150 mm. The radially inner part 42 is typically located from 25 to 90 mm, optionally from 30 to 75 mm, inwardly of the outer circumferential periphery 32 of the impeller 14.

The potato deflection surface 30 is configured laterally to deflect a potato, passing towards and through the respective throat 46 in a radially outward direction toward the cutting head 4, in a deflection direction toward the adjacent orientation element 26 defining an opposite, rotationally trailing, end 50 of the respective throat 46.

In this embodiment, the orientation element 26 is a plate, and the potato deflection surface 30 comprises a substantially planar surface 30 extending in a substantially chordal direction D-D'. A radially inner end 52 of the potato deflection surface 30 is mounted to a substantially radial member 54 extending outwardly towards the outer circumferential periphery 32 of the impeller 14. A substantially radial surface 56 of the substantially radial member 54, which surface 56 is adjacent to, and inclined relative to, the potato deflection surface 30, defines the potato supporting surface 40 on a rotationally leading side of the orientation element 26.

Figure 4:
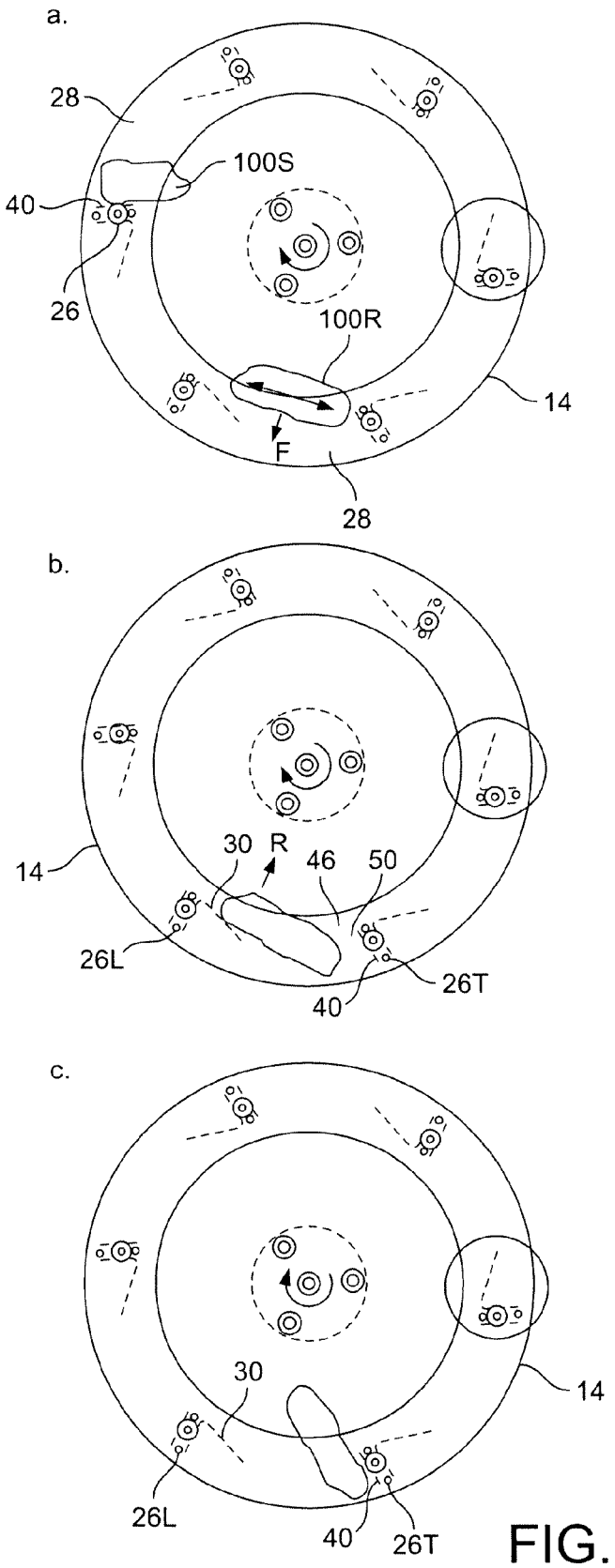
FIGS. 4*a* to 4*c* show the operation of potato slice cutting apparatus in accordance with the first embodiment of the present invention.

Referring to FIGS. 4*a* to 4*c*, the method of producing potato slices for the manufacture of potato chips using the apparatus of the embodiment of FIGS. 1 to 3 is described. In the method, a plurality of potatoes 100 is provided, at least some of which are elongate along a longitudinal direction L.

The potatoes 100 are fed into the impeller 14. The potatoes 100 are initially uncut. The impeller 14 rotates, typically at about 235 rpm, to deliver the potatoes 100 radially outwardly toward the cutting head 4 (not shown in FIGS. 4*a* to 4*c*) by a centrifugal force F into the cutting zones 28. The impeller 14 rotates in a specific rotational direction, as shown in FIGS. 4*a* to 4*c*.

Some potatoes 100*s*, as shown in FIG. 4*a*, may be smaller in every dimension than the width of the cutting zones 28. Such small potatoes 100*s* may immediately pass into one of the cutting zones 28.

Some other potatoes 1001 may be elongate and may be longer than the width of the cutting zones 28. For those elongate potatoes 1001, as shown in FIG. 4*b*, a rotationally leading part 102 of the outwardly moving elongate potato 1001 may be deflected within the impeller 14 in a rotationally rearward and inward direction R by the potato deflection surface 30 of a respective first orientation element 26L.

The potato deflection surface 30 is configured laterally to deflect a potato, passing through the respective throat 46 in a radially outward direction toward the cutting head 4, in a deflection direction toward the adjacent orientation element 26 defining an opposite end 50 of the respective throat 46.

As shown in FIG. 4*c*, such a deflection orients the longitudinal direction of the elongate potato 1001 into a substantially radial orientation, in a cutting position, with the potato 1001 urged against a supporting surface 40 of a second orientation element 26T, the second orientation element 26T being adjacent to and rotationally trailing the first orientation element 26L.

Such a radial potato orientation reduces the maximum slice dimension of slices cut from even very long potatoes. For example, at least some of the elongate potatoes have a longitudinal length which is within the range of from 100 to 250 mm, optionally from 175 to 225 mm, and each slice has a maximum width of less than the longitudinal length of the respective potato from which it is cut, the maximum width optionally being 95 mm.

Each potato 100*s* or 1001 is in the cutting position and cut into slices by the plurality of knives 8. Centrifugal force radially outwardly advances each potato in the cutting position prior to a subsequent slice cutting action.

Figure 5:
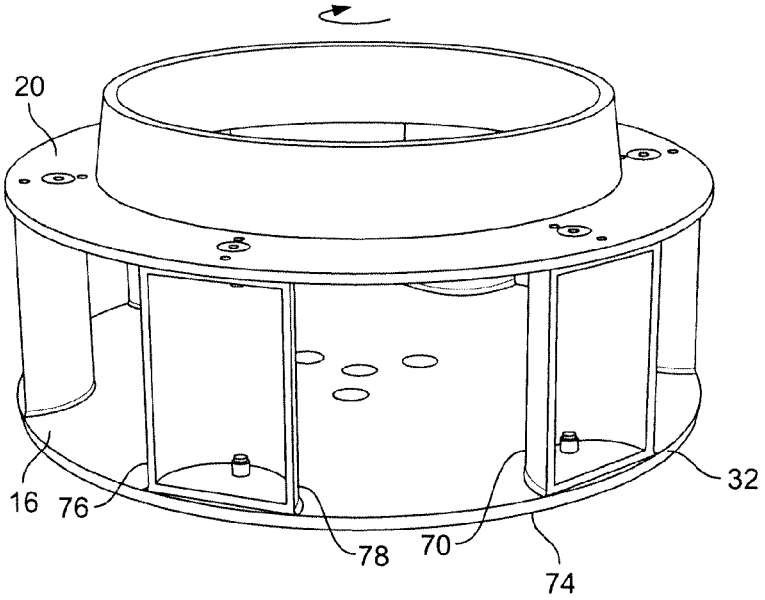
FIG. 5 is a schematic side perspective view of an impeller for mounting within the cutting head of FIG. 1 to provide a potato slice cutting apparatus in accordance with a second embodiment of the present invention.
Figure 6:
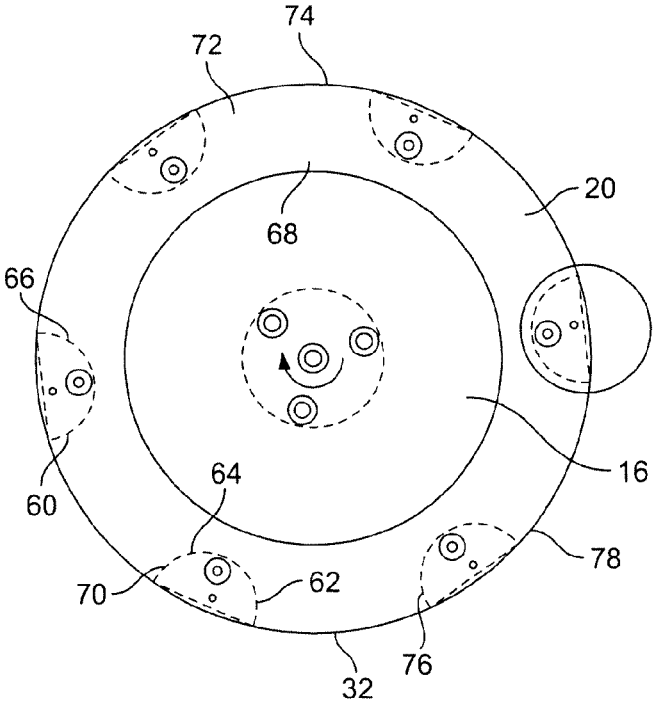
FIG. 6 is a plan view of the impeller of FIG. 5.

In a second embodiment, as shown in FIGS. 5 and 6, the orientation element 70 has a different configuration from that of the embodiment of FIGS. 1 to 3, but the cutting head 4 and the remaining parts of the impeller 74 are similar in configuration to the embodiment of FIGS. 1 to 3.

A plurality of orientation elements 70, in this embodiment six orientation elements 70, are fitted between the base 16 and cover 20. In this embodiment, the orientation element 70 is an arcuate plate, which in this embodiment has a substantially semi-circular or semi-elliptical cross-section and extends upwardly between the base 16 and the cover 20. Opposed rotationally leading and trailing edges 76, 78 thereof are located substantially at the outer circumferential periphery 32 of the impeller 74. Each orientation element 70 defines a potato deflection surface 60 on a first side of the orientation element 70 and a potato supporting surface 66 on a second side of the orientation element 70. The impeller 74 is adapted to rotate in a specific rotational direction, and the first side of the orientation element 70 is a rotationally trailing side and the second side of the orientation element 70 is a rotationally leading side. At least a part of each potato deflection surface 60 extends in a direction having a first component in the circumferential direction and at least a second component in the radial direction so that the potato deflection surface 60 at least partly faces inwardly with respect to the outer circumferential periphery 32 of the impeller 74. The potato deflection surface 60 extends between radially inner and radially outer parts of the respective orientation element 70. The potato deflection surface 60 is on a rotationally trailing side 62 of the orientation element 70, and the opposite rotationally leading side 64 of the orientation element 74 defines the potato supporting surface 66.

In this embodiment, the potato deflection surface 60 comprises an arcuate surface 60 which is typically convex. The potato deflection surface 60 has a substantially arc-like cross-section. The potato supporting surface 66 also comprises an arcuate surface 66 which is typically convex. The potato supporting surface 66 has a substantially arc-like cross-section. The potato deflection surface 60 and the potato supporting surface 66 are integrally connected to form a unitary orientation element 70 which has a substantially semi-circular or semi-elliptical cross-section.

The plurality of orientation elements 70 are serially and annularly mounted within the impeller 74 to define a plurality of cutting zones 72 located around the impeller 74, each cutting zone 72 being between adjacent orientation elements 70. Adjacent orientation elements 70 are separated in a substantially circumferential direction to define a throat 68 for passage therethrough of a potato in a radially outward direction toward cutting head 4.

The impeller 74 of the second embodiment functions to orient elongate potatoes radially in a manner similar to that of the first embodiment. The restricted throat 68 is defined between adjacent orientation elements 70, so that elongate potatoes dimensioned above a particular longitudinal length can only enter the cutting zone 72 in a substantially radial orientation after having been deflected by the deflection surface 60 of a leading orientation element 70 to lie radially against the potato supporting surface 66 of the adjacent trailing orientation element 70.

Figure 7:
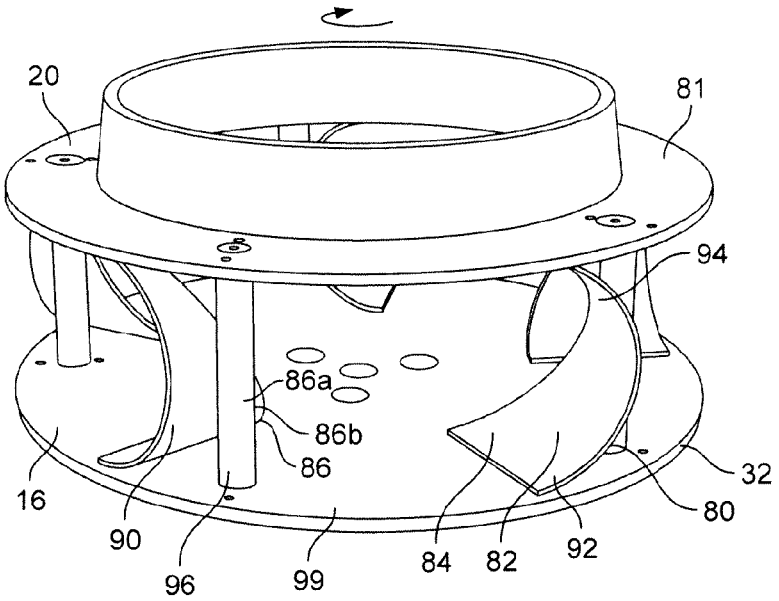
FIG. 7 is a schematic side perspective view of an impeller for mounting within the cutting head of FIG. 1 to provide a potato slice cutting apparatus in accordance with a third embodiment of the present invention.
Figure 8:
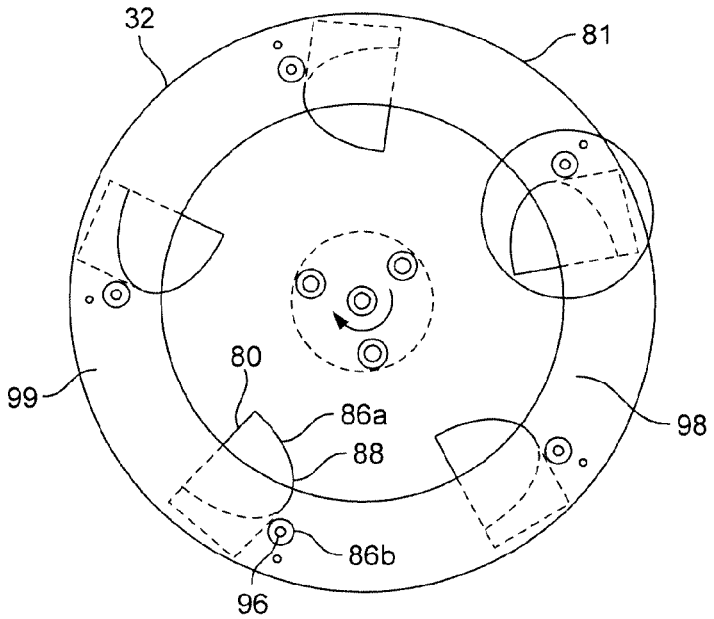
FIG. 8 is a plan view of the impeller of FIG. 7.

In a third embodiment, as shown in FIGS. 7 and 8, the orientation element 80 has a different configuration from that of the embodiment of FIGS. 1 to 3, but the cutting head 4 and the remaining parts of the impeller 81 are similar in configuration to the embodiment of FIGS. 1 to 3.

The plurality of orientation elements 80 are serially and annularly mounted within the impeller 81 to define a plurality of cutting zones 99 located around the impeller 81, each cutting zone 99 being between adjacent orientation elements 80. Each orientation element 80 defines a potato deflection surface 86 on a first rotationally trailing side of the orientation element 80 and a potato supporting surface 82 on a second rotationally leading side of the orientation element 80. A plurality of orientation elements 80, in this embodiment five orientation elements 80, are fitted between the base 16 and cover 20. Alternatively, six orientation elements 80 may be provided.

In this embodiment, the potato supporting surface 82 is on a rotationally leading side 84 of the orientation element 80 and the potato deflection surface 86 is on a rotationally trailing side 88 of the orientation element 80, the impeller 81 being adapted to rotate in a specific rotational direction. A first part of the orientation element 80 is a curved plate 90 which decreases in width from a lower end 92, fixed to the base 16, towards an upper end 94, fixed to the cover 20. The curved plate 90 of the orientation element 80 defines a concave potato supporting surface 82. The curved plate 90 is helically curved to define at least a part 86*a* of the convex potato deflection surface 86. In addition, adjacent to each curved plate 90 is located a rod 96, typically cylindrical in cross-section, which is upwardly directed and fitted between the base 16 and cover 20. The rod 96 comprises a second part of the respective orientation element 80 which defines at least a part 86*b* of the convex potato deflection surface 86. The rod 96 has a smoothly curved substantially cylindrical surface.

At least a part of each potato deflection surface 86*a*, 86*b* extends in a direction having a first component in the circumferential direction and at least a second component in the radial direction so that the potato deflection surface 86 at least partly faces inwardly with respect to an outer circumferential periphery 32 of the impeller 81. Adjacent orientation elements 80 are separated in a substantially circumferential direction to define a throat 98 for passage therethrough of a potato in a radially outward direction toward cutting head 4.

The impeller 81 of the third embodiment functions to orient elongate potatoes radially in a manner similar to that of the first and second embodiments. The restricted throat 98 is defined between adjacent orientation elements 80, so that elongate potatoes dimensioned above a particular longitudinal length can only enter the cutting zone 99 in a substantially radial orientation after having been deflected by the deflection surface 86*a* on plate 90 and/or deflection surface 86*b* on rod 96 of a leading orientation element 80 to lie radially against the potato supporting surface 82 of the adjacent trailing orientation element 80.

Figure 9:
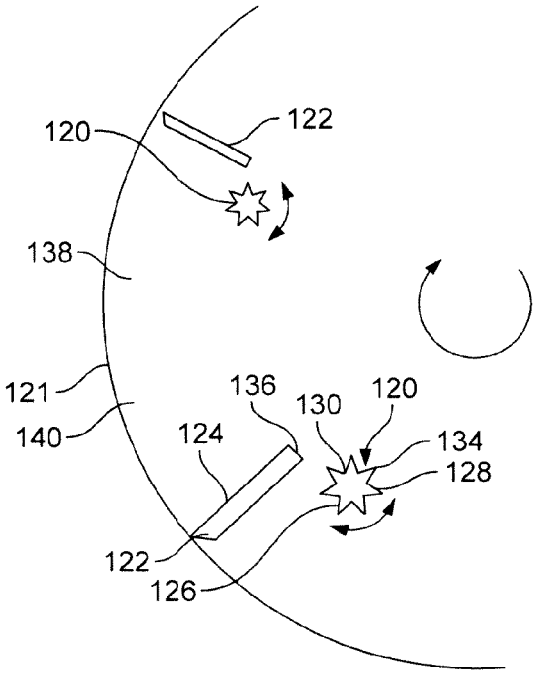
FIG. 9 is a schematic plan view of part of an impeller for mounting within the cutting head of FIG. 1 to provide a potato slice cutting apparatus in accordance with a fourth embodiment of the present invention.

In a fourth embodiment, as shown in FIG. 9, the orientation element 120 has a different configuration from that of the embodiment of FIGS. 1 to 3, but the cutting head 4 and the remaining parts of the impeller 121 are similar in configuration to the embodiment of FIGS. 1 to 3.

A plurality of orientation elements 120, in this embodiment seven orientation elements 80, are fitted between the base and cover. In this embodiment, the orientation element 120 comprises a first component 122 defining a substantially radial potato supporting surface 124 and a second component 126 defining a potato deflection surface 128. The first and second components 122, 126 are mutually separated. The first component 122 is on a rotationally leading side of the orientation element 120 and the second component 126 is on a rotationally trailing side of the orientation element 120, the impeller 121 being adapted to rotate in a specific rotational direction. The first component 122 comprises a plate 122 which is substantially radially oriented. The second component 126 comprises an upwardly directed rotatable spindle 126 which is fitted between the base and cover. An outer surface 128 of the spindle 126 has longitudinal grooves 130. The spindle 126 typically has a diameter of from 10 to 25 mm, optionally about 15 mm. The spindle 126 is located radially inwardly of the plate 122. Typically, a radially inner surface 134 of the spindle 126 is located a distance of from 5 to 20 mm, optionally about 10 mm, radially inwardly of radially inner surface 136 of the plate 122.

The spindle 126 defines the potato deflection surface 128 which is generally convex. The plate 122 defines the potato supporting surface 124 which is generally planar or slightly curved, about a large radius of curvature.

At least a part of each potato deflection surface 128 extends in a direction having a first component in the circumferential direction and at least a second component in the radial direction so that the potato deflection surface 128 at least partly faces inwardly with respect to an outer circumferential periphery 32 of the impeller 121. Adjacent orientation elements 120 are separated in a substantially circumferential direction to define a throat 138 for passage therethrough of a potato in a radially outward direction toward the cutting head 4.

The impeller 121 of the fourth embodiment functions to orient elongate potatoes radially in a manner similar to that of the first, second and third embodiments. The restricted throat 138 is defined between adjacent orientation elements 120, in particular between the spindle 126 of a rotationally leading orientation element 120 and the plate of the adjacent rotationally trailing orientation element 120, so that elongate potatoes dimensioned above a particular longitudinal length can only enter the cutting zone 140 in a substantially radial orientation after having been deflected by the potato deflection surface 128 of the spindle 126 of a leading orientation element 120 to lie radially against the potato supporting surface 124 of the adjacent trailing orientation element 120.

Figure 12:
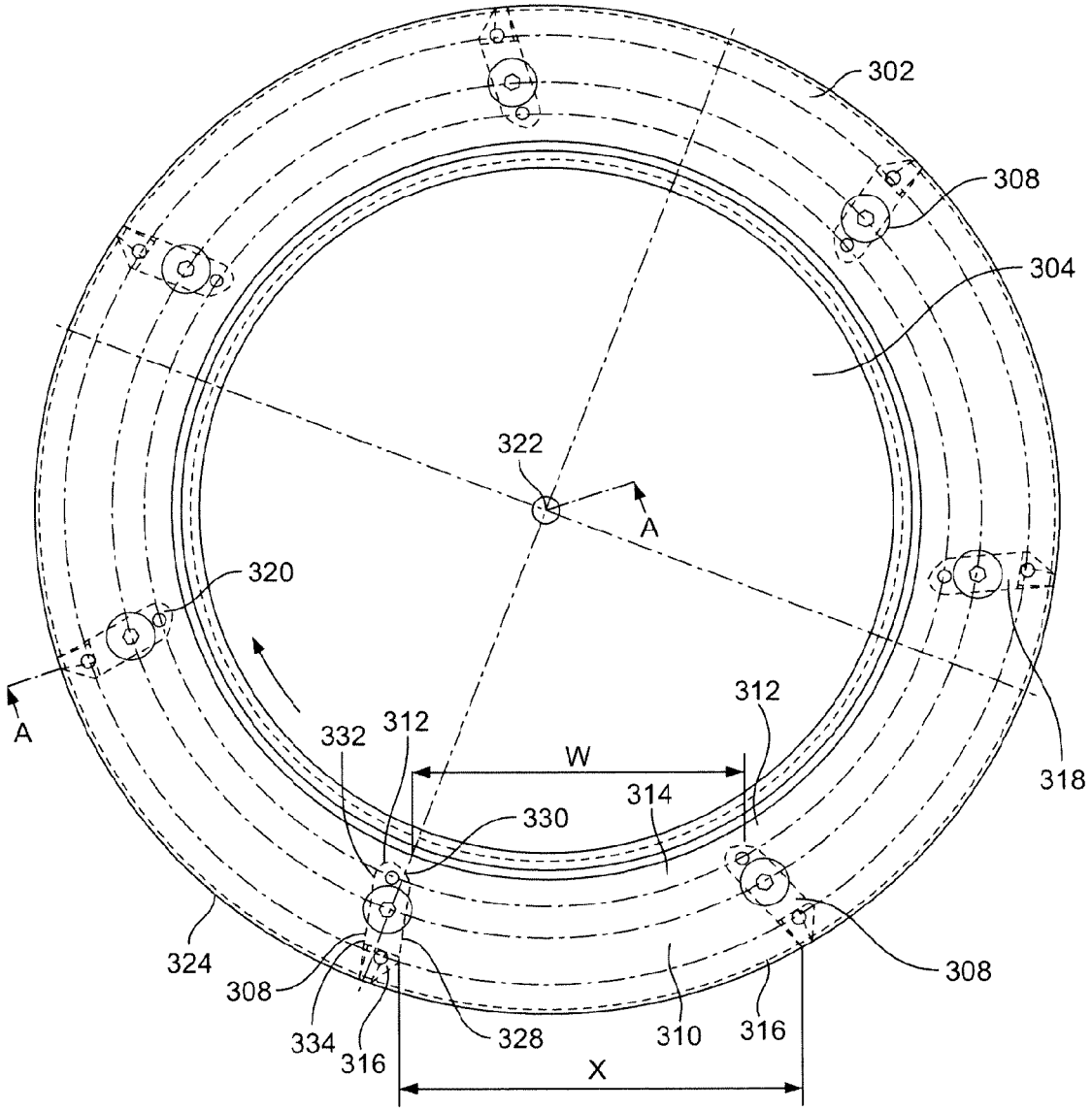
FIG. 12 is a schematic plan view of an impeller for mounting within the cutting head of FIG. 1 to provide a potato slice cutting apparatus in accordance with a fifth embodiment of the present invention.
Figure 13:
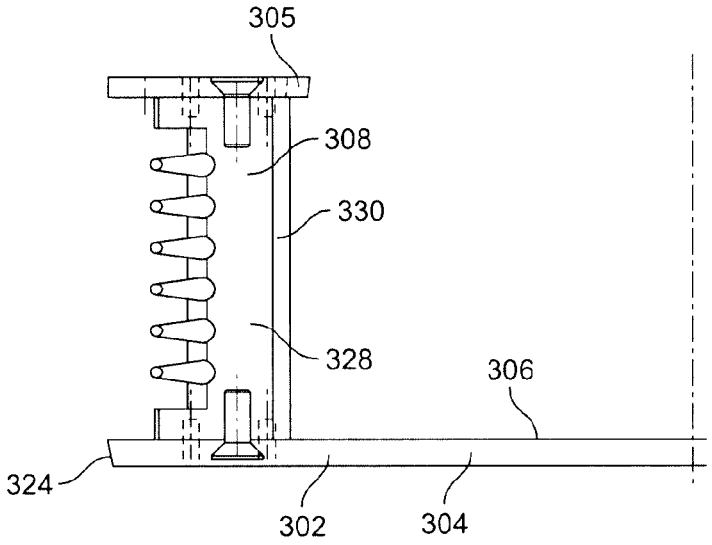
FIG. 13 is an part-sectional view on line A-A view of the impeller of FIG. 12 showing an orientation element in the form of a plate member mounted in the impeller.

A further embodiment of an impeller for an apparatus for cutting potato slices is illustrated in FIGS. 12 and 13. The apparatus comprises an annular-shaped cutting head 4 as illustrated in FIG. 1. The central impeller 302 is coaxially mounted for rotation within the cutting head for delivering potatoes radially outwardly toward the cutting head. The impeller 302 has a base 304 with an upper surface 306 across which potatoes are, in use, delivered to the cutting head.

As disclosed above with respect to FIG. 1, a plurality of knives are serially mounted annularly around the cutting head, each knife having a cutting edge extending substantially upwardly and spaced from the cutting head to provide a gap, extending in a radial direction, between the first cutting edge and the cutting head.

A plurality of orientation elements 308 is serially and annularly mounted within the impeller 302 to define a plurality of cutting zones 310 located around the impeller 302. At least one part of each orientation element 308 extends in a direction upwardly from the upper surface 306 of the base plate 304. Lower and upper ends of the orientation elements 308 are fitted, by screws and dowels for example, to the base plate 304 and an annular top plate 305 respectively. The orientation elements 308 have the same shape and dimensions and are equally spaced around the impeller 302. Each cutting zone 310 is between adjacent orientation elements 308. Radially inner parts 312 of adjacent orientation elements 308 are separated in a substantially circumferential direction. The separation defines, between adjacent orientation elements 310, a throat 314 for passage therethrough of a potato in a radially outward direction into the respective cutting zone 310 toward the cutting head 4.

The throat 314 has a width W of from 70 to 140 mm, optionally from 90 to 130 mm, further optionally from 100 to 120 mm, yet further optionally from 105 to 115 mm, typically about 110 mm. The cutting zone 310 has a maximum width X, defined between radially outer ends 316 of adjacent orientation elements 308, which is greater than the respective throat 314, for example greater than 130 mm. Typically, radially outer ends 316 of adjacent orientation elements 308 are separated by a distance of up to 150 mm.

The orientation element 308 comprises a plate member 318 which is oriented in a substantially radial direction. Typically, the orientation element 308 has a radial length of from 35 to 50 mm, and/or a radially inner end 320 of the orientation element 308 is located from 125 to 145 mm from a rotational axis 322 of the impeller 302.

The orientation elements 308 typically extend from 25 to 90 mm, further optionally from 30 to 75 mm, inwardly of an outer periphery 324 of the impeller 302. The radially inner part 312 is typically located from 35 to 60 mm inwardly of the outer periphery 324 of the impeller 302.

In the illustrated embodiment of FIG. 12 there are seven orientation elements 308 and the throat 314 has a width of from 100 to 120 mm, typically about 110 mm.

In a modification of the illustrated embodiment of FIG. 12, there are six orientation elements 308 and the throat 314 has a width of from 120 to 140 mm, optionally about 130 mm.

The apparatus further comprises a motor (not shown) for rotating the impeller 302. The motor has a rotational velocity typically of from 180 to 260 rpm, typically from 220 to 250 rpm, and typically the impeller 302 when in operation has an angular velocity of from 17.5 to 27.5 radians/second. The impeller 302 is adapted to rotate in a specific rotational direction. A first side 328 of the orientation element 308 is a rotationally trailing side and defines a potato deflection surface 330 and the second side 332 of the orientation element 308 is a rotationally leading side and defines a potato supporting surface 334.

The potato deflection surface 330 is configured laterally to deflect a potato, passing through the respective throat 314 in a radially outward direction toward the cutting head 4, in a deflection direction toward the adjacent orientation element 308 defining an opposite end of the respective throat 314.

The potato deflection surface 330 extends in a direction having a first component in the circumferential direction and at least a second component in the radial direction so that the potato deflection surface 330 at least partly faces inwardly with respect to the outer periphery 324 of the impeller 302. The potato deflection surface 330 comprises a substantially planar surface extending in a substantially chordal direction. The potato deflection surface 330 is inclined at an angle of from 30 to 60 degrees to the radial direction. Typically the potato deflection surface 330 is inclined at an angle of 30 degrees to a plane orthogonal to the longitudinal direction of the plate member 318.

The potato deflection surface 330 is located at a radially inner end 320 of the orientation element 308 which comprises the plate member 318 which is substantially radially oriented, although in this embodiment the orientation element 308 is inclined forwardly, relative to the specific rotational direction, of a radial direction, for example inclined at an angle of from 5 to 15 degrees to the radial direction.

The cutting apparatus incorporating the impeller had of FIG. 12 is used in a method of producing potato slices for the manufacture of potato chips.

The method comprising providing a plurality of potatoes, at least some of which are elongate along a longitudinal direction. At least some of the elongate potatoes have a longitudinal length which is within the range of from 70 to 250 mm, typically from 100 to 250 mm more typically from 160 to 225 mm, for example from 175 to 225 mm. Typically, a majority of the elongate potatoes have a longitudinal length which is within the respective range.

The potatoes are fed into the impeller 302. Typically, the potatoes fed to the impeller 302 are initially uncut.

The impeller 302 rotates to deliver the potatoes radially outwardly toward the cutting head 4 by a centrifugal force into the cutting zones 310.

For at least some of the elongate potatoes, a rotationally leading part of the outwardly moving elongate potato is deflected within the impeller 302 in a rotationally rearward and inward direction by a potato deflection surface 330 of a respective first orientation element 308. The potato deflection surface 308 at least partly faces inwardly with respect to the outer periphery 324 of the impeller 302. The deflection orients the longitudinal direction of the elongate potato into a substantially radial orientation, in a cutting position, with the potato urged against the potato supporting surface 334 of a second orientation element 308. The second orientation element 308 is adjacent to and rotationally trails the first orientation element 308.

Each oriented potato is then cut in the cutting position into slices by the plurality of knives. Centrifugal force radially outwardly advances each potato in the cutting position prior to a subsequent slice cutting action. Typically, each slice has a maximum width of less than the longitudinal length of the respective potato from which it is cut. Typically, the maximum width is from 90 to 100 mm, for example about 95 mm.

In the various embodiments of the invention, the dimensions of the throat are selected based on the dimensions of the potatoes to be sliced, so that potatoes of a minimum longitudinal dimension are reliably deflected by the potato deflection elements so as to be oriented substantially radially during the slicing operation. The number of potato deflection elements for a given slicer head/impeller dimension can be modified so as to vary the throat dimensions. For any embodiment of the present invention, any number of from 4 to 10 potato deflection elements may be employed. Reduction of the throat dimension would increase the minimum potato size which would be horizontally deflected and rotated to present the smallest facial dimension of the potato at the cutting zone.

In the various embodiments of the present invention, the selected throat dimension is dependent upon the dimensions of the specific population or batch of potatoes to be cut in the particular cutting operation. The aim is to set the throat dimension so that large. elongate potatoes can be processed by the potato chip cutting apparatus to form potato slices, yet the resultant slices have a size distribution which (a) minimizes the aspect ratio of the cut slices packaging losses while additionally (b) maximizing the uniformity of the slices and (c) minimizes the number and proportion of large dimension slices. This selected throat dimension can readily be determined by reasonable trial and error, and typically ranges from 70 to 150 mm, for example when the potatoes to be sliced have a longitudinal length which is within the range of from 100 to 250 mm, optionally from 175 to 225 mm.

In the method of manufacturing potato chips of the embodiment of the invention, after the plurality of potato slices has been cut, the potato slices are cooked and seasoned to produce flavored potato chips. Thereafter, a measured amount of the potato chips is filled into a package. Typically, the package comprises a flexible bag, of selected dimensions, for packaging a defined weight of the potato chips. The bag is filed by, for example, a known vertical form, fill and seal (VFFS) machine. During the filling step, the package has an upper opening presenting a maximum width dimension, through which the potato chips are filled downwardly into the bag under gravity. In a preferred embodiment of the invention, the potato chips have a maximum width which is no more than 90% of the maximum width dimension of the opening. Typically, the potato chips have a maximum width which is no more than 80% of the maximum width dimension of the opening.

Again, the aim is to minimize excessively large slices to minimize packaging waste by minimizing the production of longitudinally cut potato slices by setting the throat dimension based upon the dimensional analysis of the potato supply. This setting can be achieved on a trial and error basis following an initial short run of a small population size representative of the larger population in a typical batch for commercial processing on a potato chip production line.

In the preferred embodiments, a particular cutting head is disclosed. However, the present invention can be utilized with a wide variety of different cutting head shapes and dimensions.

In addition, in the illustrated embodiment of the invention, the cutting head is stationary and the impeller rotates within the stationary cutting head. In alternative embodiments of the invention, the cutting head also rotates, and the impeller rotates within the rotating cutting head, with the cutting head and impeller either rotating in the same rotational direction but at different rotational speeds or rotating in opposite rotational directions.

Furthermore, the present invention can be utilized with various blade shapes and configuration, and accordingly the cutting head can be used with linear planar blades, such as for manufacturing conventional potato chips, or profiled blades, such as for manufacturing crinkle cut or other three dimensionally-shaped potato chips.

The cutting head of the preferred embodiments of the invention may be of the two ring or single ring type.

The present invention will now be illustrated further with reference to the following non-limiting Examples.

Comparative Example 1

Figure 10:
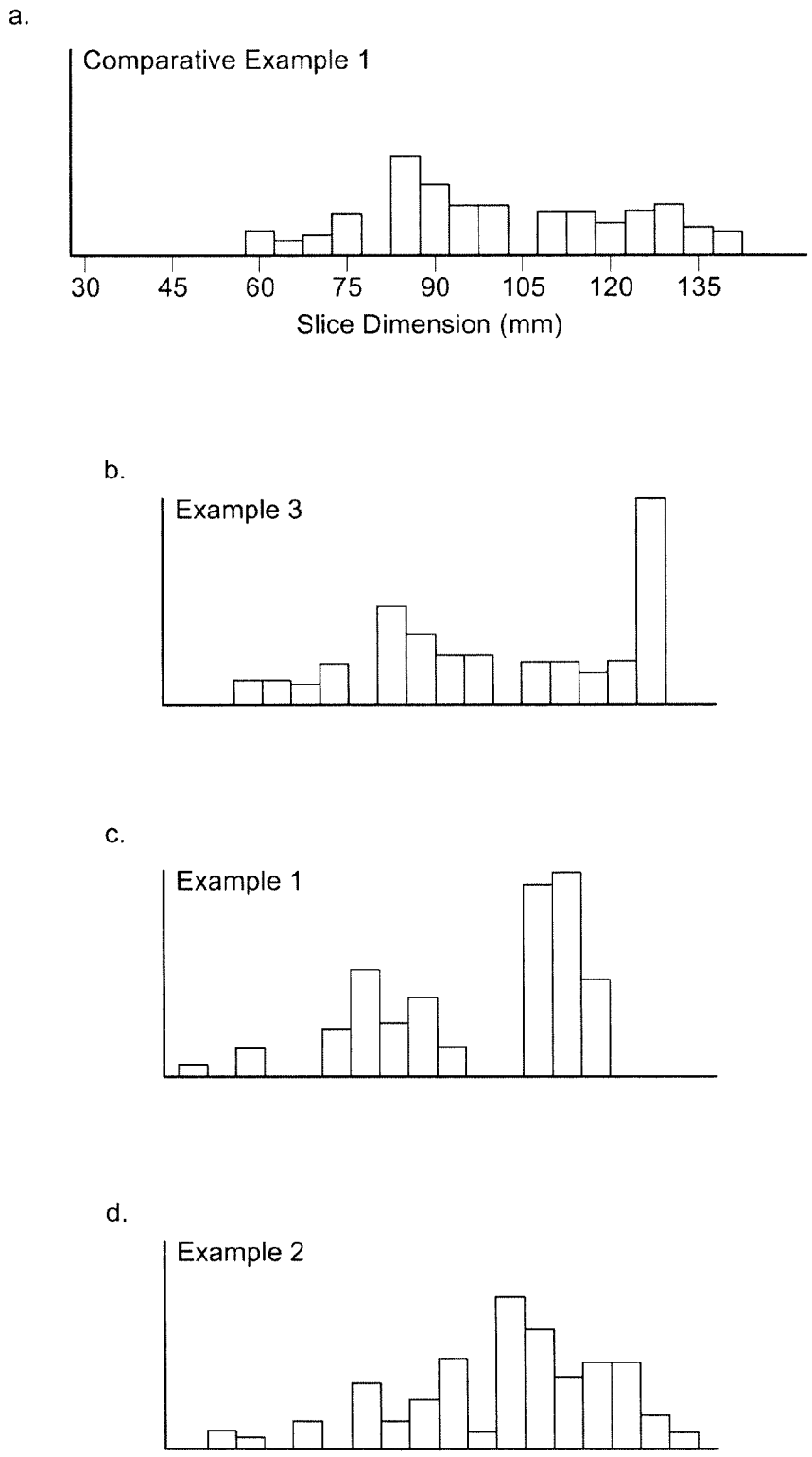
FIG. 10 is a graph showing potato slice populations produced in Examples and Comparative Examples.
Figure 11:
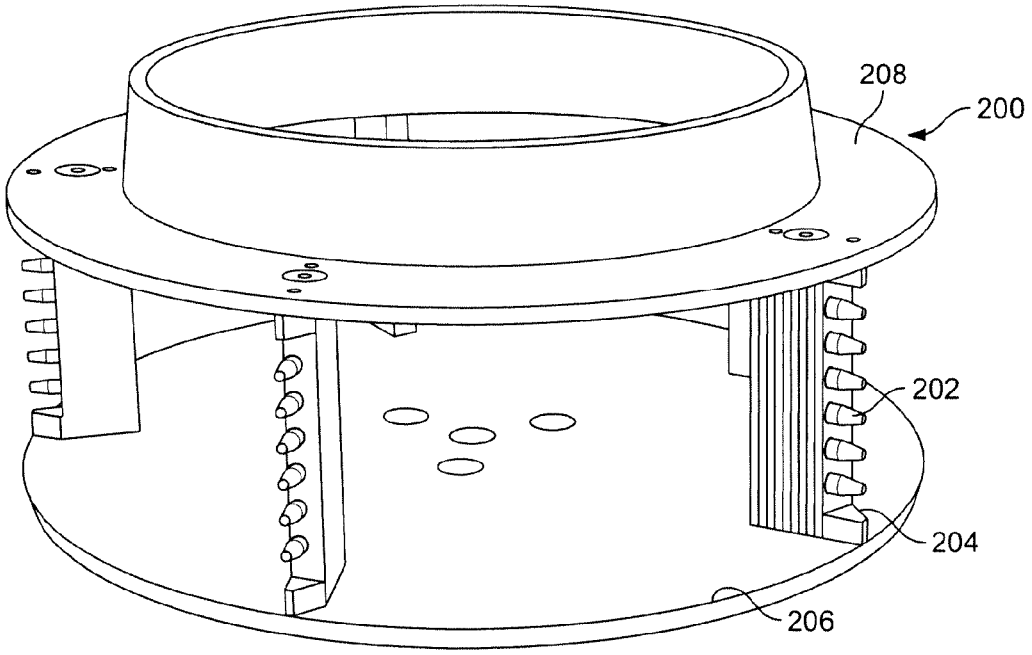
FIG. 11 is schematic side perspective view of a known impeller for mounting within the cutting head of FIG. 1.

A potato slice cutting apparatus having the structure of FIG. 11 was employed to cut potato slices for the manufacture of potato chips. FIG. 10 shows a known impeller 200 having radial paddles 202 located around the impeller 200. The radial paddles 202 each define a radial potato supporting surface 204 on the rotationally leading side of the paddle 202. The impeller 200 has a base 206 and a cover 208 between which the paddles 202 are mounted. However, there is no potato deflection element or potato deflection surface as required by the present invention. The impeller had five radial paddles 202 equally spaced around the impeller 200. The throat dimension between adjacent paddles was 150 mm.

The potatoes had been graded to provide a longitudinal dimension greater than the throat dimension between the orientation elements. The potatoes were graded to have a longitudinal dimension of 160 mm and a width of from 90 to 100 mm. These potatoes were sliced and the dimensions of the resultant slices were analysed. The results are shown in Table 1 and FIG. 10*a*.

A total number of 369 slices was measured. The mean maximum slice dimension was 100 mm with a standard deviation of 23.1 mm. The slice dimensions of the population are shown in FIG. 10*a*.

Figure 14A:
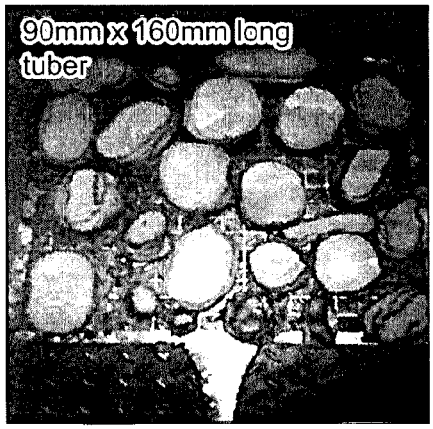
FIGS. 14*a* and 14*b* respectively show potato slices produced using the impeller of FIG. 11 in a Comparative Example and potato slices produced using the impeller of FIG. 12 in an Example.

The population of the slices is also illustrated in FIG. 14*a*. It may be seen that the slices have significantly varying dimensions and shapes.

Figure 15A:
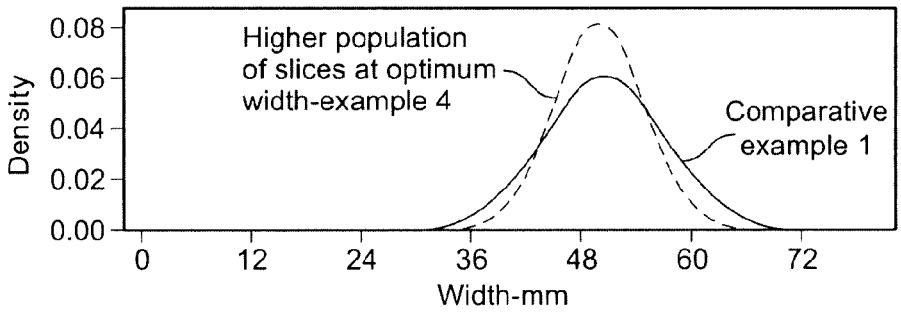
FIGS. 15*a* and 15*b* show graphs indicating the slice size, respectively slice width and slice length, of potato slices produced using the impeller of FIG. 12 in an Example and potato slices produced using the impeller of FIG. 11 in a Comparative Example.
Figure 15B:
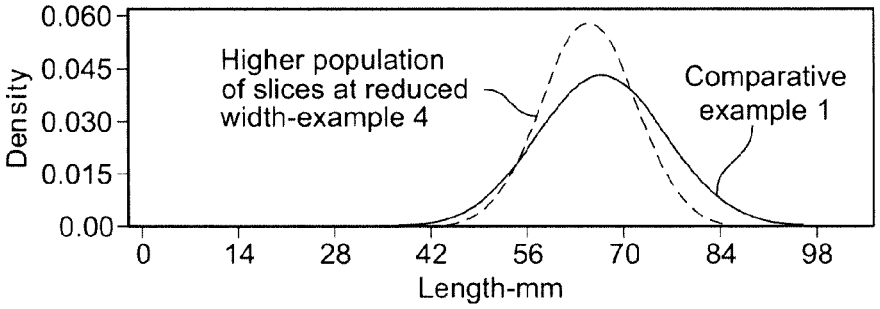

FIGS. 15*a* and *b* show graphs indicating the slice size, respectively slice width and slice length, of potato slices produced using the impeller of FIGS. 12 and 13 in Example 4, discussed further below, and potato slices produced using the impeller of FIG. 11 in Comparative Example 1. In each of Example 4 and Comparative Example 1 a population of 3000 slices was measured.

TABLE 1

| | Slice Sample Size | Mean Maximum Slice Dimension | Slice Dimension Standard Deviation |
|---|---|---|---|
| Example 1 | 508 | 80 | 17.5 |
| Example 2 | 484 | 83 | 18.2 |
| Comparative Example 1 | 369 | 100 | 23.1 |
| Example 3 | 419 | 90 | 19.2 |

Example 1

A potato slice cutting apparatus having the structure of FIGS. 1 to 3 was employed to cut potato slices for the manufacture of potato chips. The potatoes had been graded to provide a longitudinal dimension greater than the throat dimension between the orientation elements. The potatoes were the same as for Comparative Example 1 and were graded to have a longitudinal dimension of 160 mm and a width of from 90 to 100 mm. The impeller had seven orientation elements. The throat dimension between adjacent orientation elements was 95 mm.

These potatoes were sliced and the dimensions of the resultant slices were analysed. The results are shown in Table 1 and FIG. 10*c*.

A total number of 508 slices was measured. The mean maximum slice dimension was 80 mm with a standard deviation of 17.5 mm. The slice dimensions of the population are shown in FIG. 10*c*.

Example 2

A potato slice cutting apparatus having the structure of FIGS. 5 and 6 was employed to cut potato slices for the manufacture of potato chips. The potatoes were the same as for Example 1 and the impeller also had seven orientation elements. The throat dimension between adjacent orientation elements was 100 mm.

These potatoes were sliced and the dimensions of the resultant slices were analysed. The results are shown in Table 1 and FIG. 10*d*.

A total number of 484 slices was measured. The mean maximum slice dimension was 83 mm with a standard deviation of 18.2 mm. The slice dimensions of the population are shown in FIG. 10*d*.

Example 3

A potato slice cutting apparatus having the impeller structure of FIG. 11 was employed to cut potato slices for the manufacture of potato chips. The potatoes were the same as for Comparative Example 1 but, as compared to Comparative Example 1, the impeller had seven radial paddles. The throat dimension between adjacent paddles was 110 mm.

These potatoes were sliced and the dimensions of the resultant slices were analysed. The results are shown in Table 1 and FIG. 10*b*.

A total number of 419 slices was measured. The mean maximum slice dimension was 90 mm with a standard deviation of 19.2 mm. The slice dimensions of the population are shown in FIG. 10*b*.

Example 4

A potato slice cutting apparatus having the impeller structure of FIGS. 12 and 13 was employed to cut potato slices for the manufacture of potato chips. The potatoes were the same as for Comparative Example 1 but, as compared to Comparative Example 1, the impeller had seven radial paddles, and an inclined potato deflection surface at an end of the plate member forming the paddle, which constituted an orientation element. The throat dimension between adjacent paddles was 109 mm.

These potatoes were sliced and the dimensions of the resultant slices were analysed.

Figure 14B:
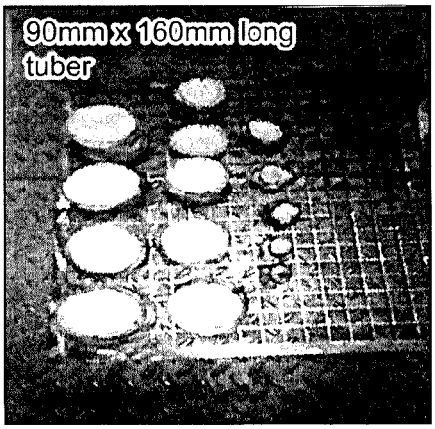

The population of the slices is illustrated in FIG. 14*b*. It may be seen that the slices have significantly more uniform dimensions and shapes as compared to the slices of Comparative Example 1

FIGS. 15*a* and *b* show graphs indicating the slice size, respectively slice width and slice length, of potato slices (a population of 3000 slices was tested) produced using the impeller of FIGS. 12 and 13 in this Example 4 and potato slices produced using the impeller of FIG. 11 in Comparative Example 1. It may be seen that using the impeller of Example 4 according the invention, using a 109 mm throat dimension and an inclined deflection surface, there is a higher population of slices at optimum width and also a higher population of slices at reduced length, as compared to using a throat dimension of 150 mm.

A comparison of the results of Examples 1, 2 and 4 and Comparative Example 1 shows that the provision of potato deflection elements in an impeller in accordance with one aspect of the present invention can reduce the mean maximum slice dimension and also make the slice population more uniform in dimensions as compared to the use of radial paddles.

In addition, Comparative Example 1 and Examples 3 and 4 show that by increasing the number of radial paddles from five to seven can reduce the mean maximum slice dimension and also make the slice population more uniform in dimensions, and a corresponding improvement may be achieved using six radial paddles and a throat dimension of 130 mm, The addition of potato deflection surfaces to cause deflection and radial orientation of the potatoes in accordance with one aspect of the present invention can provide an even further reduction in the mean maximum slice dimension and an even further increase in uniformity of the slice dimensions of the population of slices.

For a large potato chip manufacturing oration, this reduction in the mean maximum slice dimension and an even further increase in uniformity of the slice dimensions of the population of slices would provide a significant saving in packaging and product waste corresponding potentially to millions of dollars in annual savings in production costs.

Other modifications to the potato slice cutting device of the preferred embodiments of the present invention will be readily apparent to those skilled in the art.

Additional Description

The following clauses are offered as further description of the disclosed invention.

1. An apparatus for cutting potato slices, the apparatus comprising an annular-shaped cutting head and a central impeller coaxially mounted for rotation within the cutting head for delivering potatoes radially outwardly toward the cutting head, the impeller having a base with an upper surface across which potatoes are, in use, delivered to the cutting head, a plurality of knives serially mounted annularly around the cutting head, each knife having a cutting edge extending substantially upwardly and spaced from the cutting head to provide a gap, extending in a radial direction, between the cutting edge and the cutting head, and a plurality of orientation elements serially and annularly mounted within the impeller to define a plurality of cutting zones located around the impeller, each cutting zone being between adjacent orientation elements, wherein radially inner parts of adjacent orientation elements are separated in a substantially circumferential direction to define between adjacent orientation elements a throat for passage therethrough of a potato in a radially outward direction into the respective cutting zone toward the cutting head, wherein the throat has a width of from 70 to 140 mm.
2. The apparatus according to clause 1 wherein the throat has a width of from 90 to 130 mm.

3. The apparatus according to clause 2 wherein the throat has a width of from 100 to 120 mm.
4. The apparatus according to clause 3 wherein the throat has a width of from 105 to 115 mm.
5. The apparatus according to any foregoing clause wherein the cutting zone has a maximum width, defined between radially outer ends of adjacent orientation elements, which is greater than 130 mm.
6. The apparatus according to clause 5 wherein radially outer ends of adjacent orientation elements are separated by a distance of up to 150 mm.
7. The apparatus according to any foregoing clause wherein the orientation element comprises a plate member which is oriented in a substantially radial direction.
8. The apparatus according to any foregoing clause wherein the orientation element has a radial length of from 35 to 50 mm.
9. The apparatus according to any foregoing clause wherein a radially inner end of the orientation element is located from 125 to 145 mm from a rotational axis of the impeller.
10. The apparatus according to any foregoing clause further comprising a motor for rotating the impeller, the motor having a rotational velocity of from 180 to 260 rpm or is adapted to rotate the impeller at an angular velocity of from 17.5 to 27.5 radians/second.
11. The apparatus according to any foregoing clause wherein at least one part of each orientation element extends in a direction upwardly from the upper surface.
12. The apparatus according to any foregoing clause wherein the orientation elements have the same shape and dimensions.
13. The apparatus according to any foregoing clause wherein the orientation elements are equally spaced around the impeller.
14. The apparatus according to any foregoing clause wherein the orientation elements extend from 25 to 90 mm, optionally from 30 to 75 mm, inwardly of an outer periphery of the impeller.
15. The apparatus according to any foregoing clause wherein the radially inner part is located from 35 to 60 mm inwardly of an outer periphery of the impeller.
16. The apparatus according to any foregoing clause wherein there are seven orientation elements and the throat has a width of from 100 to 120 mm, optionally about 110 mm.
17. The apparatus according to any one of clauses 1 to 15 wherein there are six orientation elements and the throat has a width of from 120 to 140 mm, optionally about 130 mm.
18. The apparatus according to any foregoing clause wherein the impeller is adapted to rotate in a specific rotational direction, and a first side of the orientation element is a rotationally trailing side and defines a potato deflection surface and the second side of the orientation element is a rotationally leading side and defines a potato supporting surface.
19. The apparatus according to clause 18 wherein the potato deflection surface is configured laterally to deflect a potato, passing through the respective throat in a radially outward direction toward the cutting head, in a deflection direction toward the adjacent orientation element defining an opposite end of the respective throat.
20. The apparatus according to clause 18 or clause 19 wherein the potato deflection surface extends in a direction having a first component in the circumferential direction and at least a second component in the radial direction so that the potato deflection surface at least partly faces inwardly with respect to an outer periphery of the impeller.
21. The apparatus according to clause 20 wherein the potato deflection surface comprises a substantially planar surface extending in a substantially chordal direction.
22. The apparatus according to clause 21 wherein the potato deflection surface is inclined at an angle of from 30 to 60 degrees to the radial direction.
23. The apparatus according to any one of clauses 18 to 22 wherein the potato deflection surface is located at a radially inner end of the orientation element which comprises a plate member which is substantially radially oriented.
24. The apparatus according to any foregoing clause wherein the orientation element is inclined forwardly, relative to the specific rotational direction, of a radial direction.
25. The apparatus according to clause 16 wherein the orientation element is inclined at an angle of from 5 to 15 degrees to the radial direction.
26. A method of producing potato slices for the manufacture of potato chips, the method comprising the steps of:
   a. providing a plurality of potatoes, at least some of which are elongate along a longitudinal direction, wherein at least some of the elongate potatoes have a longitudinal length which is within the range of from 70 to 250 mm;
   b. providing a cutting apparatus comprising an annular-shaped cutting head and a central impeller coaxially mounted within the cutting head for delivering potatoes radially outwardly toward the cutting head, a plurality of knives serially mounted annularly around the cutting head, each knife having a cutting edge extending substantially upwardly and spaced from the cutting head to provide a gap, extending in a radial direction, between the cutting edge and the cutting head, and a plurality of orientation elements serially and annularly mounted within the impeller to define a plurality of cutting zones located around the impeller, each cutting zone being between adjacent orientation elements, wherein radially inner parts of adjacent orientation elements are separated in a substantially circumferential direction to define between adjacent orientation elements a throat for passage therethrough of a potato in a radially outward direction into the respective cutting zone toward the cutting head, wherein the throat has a width of from 70 to 140 mm;
   c. feeding the potatoes into the impeller, the impeller rotating to deliver the potatoes radially outwardly toward the cutting head by a centrifugal force into the cutting zones;
   d. for at least some of the elongate potatoes, deflecting a rotationally leading part of the outwardly moving elongate potato within the impeller in a rotationally rearward and inward direction by a potato deflection surface of a respective first orientation element, which potato deflection surface at least partly faces inwardly with respect to an outer periphery of the impeller, so as to orient the longitudinal direction of the elongate potato into a substantially radial orientation, in a cutting position, with the potato urged against a potato supporting surface of a second orientation element, the second orientation element being adjacent to and rotationally trailing the first orientation element; and
   e. cutting each potato in the cutting position into slices by the plurality of knives, centrifugal force radially outwardly advancing each potato in the cutting position prior to a subsequent slice cutting action.

27. The method according to clause 26 wherein in step c the potatoes fed to the impeller are initially uncut.
28. The method according to clause 26 or clause 27 wherein at least some of the elongate potatoes have a longitudinal length which is within the range of from 100 to 250 mm, and each slice has a maximum width of less than the longitudinal length of the respective potato from which it is cut.
29. The method according to clause 28 wherein at least some of the elongate potatoes have a longitudinal length which is within the range of from 160 to 225 mm.
30. The method according to clause 29 wherein at least some of the elongate potatoes have a longitudinal length which is within the range of from 175 to 225 mm.
31. The method according to any one of clauses 26 to 30 wherein a majority of the elongate potatoes have a longitudinal length which is within the respective range.
32. The method according to any one of clauses 26 to 31 wherein the maximum width is from 90 to 100 mm.
33. The method according to clause 32 wherein the maximum width is about 95 mm.
34. The method according to any one of clauses 26 to 33 wherein the throat has a width of from 90 to 130 mm.
35. The method according to clause 34 wherein the throat has a width of from 100 to 120 mm.
36. The method according to clause 35 wherein the throat has a width of from 105 to 115 mm.
37. The method according to any one of clauses 26 to 36 clause wherein the cutting zone has a maximum width, defined between radially outer ends of adjacent orientation elements, which is greater than 130 mm.
38. The method according to clause 37 wherein radially outer ends of adjacent orientation elements are separated by a distance of up to 150 mm.
39. The method according to any one of clauses 26 to 38 wherein the orientation element comprises a plate member which is oriented in a substantially radial direction.
40. The method according to any one of clauses 26 to 39 wherein the orientation element has a radial length of from 35 to 50 mm.
41. The method according to any one of clauses 26 to 40 wherein a radially inner end of the orientation element is located from 125 to 145 mm from a rotational axis of the impeller.
42. The method according to any one of clauses 26 to 41 wherein the impeller is rotated at a rotational velocity of from 220 to 260 rpm or is rotated at an angular velocity of from 17.5 to 27.5 radians/second.
43. The method according to any one of clauses 26 to 42 wherein at least one part of each orientation element extends in a direction upwardly from the upper surface.
44. The method according to any one of clauses 26 to 43 wherein the orientation elements have the same shape and dimensions.
45. The method according to any one of clauses 26 to 44 wherein the orientation elements are equally spaced around the impeller.
46. The method according to any one of clauses 26 to 45 wherein the orientation elements extend from 25 to 90 mm, optionally from 30 to 75 mm, inwardly of an outer periphery of the impeller.
47. The method according to any one of clauses 26 to 46 wherein the radially inner part is located from 35 to 60 mm inwardly of an outer periphery of the impeller.
48. The method according to any one of clauses 26 to 47 wherein there are seven orientation elements and the throat has a width of from 100 to 120 mm, optionally about 110 mm.
49. The method apparatus according to any one of clauses 26 to 47 wherein there are six orientation elements and the throat has a width of from 120 to 140 mm, optionally about 130 mm.
50. The method according to any one of clauses 26 to 49 wherein the potato deflection surface extends in a direction having a first component in the circumferential direction and at least a second component in the radial direction so that the potato deflection surface at least partly faces inwardly with respect to an outer periphery of the impeller.
51. The method according to clause 50 wherein the potato deflection surface comprises a substantially planar surface extending in a substantially chordal direction.
52. The method according to clause 51 wherein the potato deflection surface is inclined at an angle of from 30 to 60 degrees to the radial direction.
53. The method according to any one of clauses 26 to 52 wherein the potato deflection surface is located at a radially inner end of the orientation element which comprises a plate member which is substantially radially oriented.
54. The method according to any one of clauses 26 to 53 wherein the orientation element is inclined forwardly, relative to the specific rotational direction, of a radial direction.
55. The method according to clause 54 wherein the orientation element is inclined at an angle of from 5 to 15 degrees to the radial direction.
56. An apparatus for cutting potato slices, the apparatus comprising an annular-shaped cutting head and a central impeller coaxially mounted for rotation within the cutting head for delivering potatoes radially outwardly toward the cutting head, the impeller having a base with an upper surface across which potatoes are, in use, delivered to the cutting head, a plurality of knives serially mounted annularly around the cutting head, each knife having a cutting edge extending substantially upwardly and spaced from the cutting head to provide a gap, extending in a radial direction, between the cutting edge and the cutting head, and a plurality of orientation elements serially and annularly mounted within the impeller to define a plurality of cutting zones located around the impeller, each cutting zone being between adjacent orientation elements, each orientation element defining a potato deflection surface on a first side of the orientation element and a potato supporting surface on a second side of the orientation element, at least a part of each potato deflection surface extending in a direction having a first component in the circumferential direction and at least a second component in the radial direction so that the potato deflection surface at least partly faces inwardly with respect to an outer periphery of the impeller.
57. The apparatus according to clause 56 wherein at least one part of each orientation element extends in a direction upwardly from the upper surface.
58. The apparatus according to clause 56 or clause 57 wherein the orientation elements have the same shape and dimensions.
59. The apparatus according to any one of clauses 56 to 58 wherein the orientation elements are equally spaced around the impeller.

60. The apparatus according to any one of clauses 56 to 59 wherein the potato deflection surface extends between radially inner and radially outer parts of the respective orientation element.
61. The apparatus according to clause 60 wherein adjacent orientation elements are separated in a substantially circumferential direction to define between adjacent orientation elements a throat for passage therethrough of a potato in a radially outward direction into the respective cutting zone toward the cutting head.
62. The apparatus according to clause 61 wherein the throat has a width of from 70 to 150 mm, optionally from 70 to 140 mm, further optionally from 90 to 130 mm, yet further optionally from 100 to 120 mm, still further optionally from 105 to 115 mm.
63. The apparatus according to clause 61 or clause 62 wherein the potato deflection surface is configured laterally to deflect a potato, passing through the respective throat in a radially outward direction toward the cutting head, in a deflection direction toward the adjacent orientation element defining an opposite end of the respective throat.
64. The apparatus according to any one of clauses 60 to 63 wherein the radially inner part is located from 25 to 90 mm, optionally from 30 to 75 mm, inwardly of an outer periphery of the impeller.
65. The apparatus according to any one of clauses 56 to 64 wherein the impeller is adapted to rotate in a specific rotational direction, and the first side of the orientation element is a rotationally trailing side and the second side of the orientation element is a rotationally leading side.
66. The apparatus according to any one of clauses 56 to 65 wherein the orientation element comprises a plate.
67. The apparatus according to any one of clauses 56 to 66 wherein the potato deflection surface comprises a substantially planar surface extending in a substantially chordal direction.
68. The apparatus according to clause 67 wherein a radially inner end of the potato deflection surface is mounted to a substantially radial member extending outwardly towards a circumferential periphery of the impeller.
69. The apparatus according to clause 68 wherein a substantially radial surface of the substantially radial member, which surface is adjacent to, and inclined relative to, the potato deflection surface, defines the potato supporting surface on a rotationally leading side of the orientation element, the impeller being adapted to rotate in a specific rotational direction.
70. The apparatus according to any one of clauses 56 to 66 wherein the potato deflection surface comprises an arcuate surface.
71. The apparatus according to clause 70 wherein the arcuate surface is convex.
72. The apparatus according to clause 71 wherein the potato deflection surface has a substantially arc-like cross-section.
73. The apparatus according to any one of clauses 70 to 72 wherein the potato supporting surface is convex.
74. The apparatus according to clause 73 wherein the potato supporting surface has a substantially arc-like cross-section.
75. The apparatus according to any one of clauses 70 to 74 wherein the potato deflection surface and the potato supporting surface are integrally connected to form a unitary orientation element which has a substantially semi-circular or semi-elliptical cross-section.
76. The apparatus according to clause 75 wherein opposed edges of the orientation element are located substantially at an outer circumferential periphery of the impeller.
77. The apparatus according to any one of clauses 56 to 66 wherein the orientation element defines a convex potato deflection surface on a first side thereof and a concave potato supporting surface on a second opposite side thereof.
78. The apparatus according to clause 77 wherein the potato supporting surface is on a rotationally leading side of the orientation element and the potato deflection surface is on a rotationally trailing side of the orientation element, the impeller being adapted to rotate in a specific rotational direction.
79. The apparatus according to any one of clauses 77 to 78 wherein the orientation element comprises an arcuate plate which decreases in width from a lower end to an upper end and which defines the potato supporting surface.
80. The apparatus according to any one of clauses 77 to 79 wherein the orientation element comprises an arcuate plate which is helically curved to define at least a part of the potato deflection surface.
81. The apparatus according to clause 79 or clause 80 wherein the orientation element further comprises an upwardly directed rod which is located adjacent to the arcuate plate and defines at least a part of the potato deflection surface.
82. The apparatus according to clause 81 wherein the rod has a smoothly curved substantially cylindrical surface.
83. The apparatus according to any one of clauses 56 to 66 wherein the orientation element comprises first component defining the potato supporting surface which is substantially radial relative to the impeller and a second component defining the potato deflection surface, the first and second components being mutually separated.
84. The apparatus according to clause 83 wherein the first component is on a rotationally leading side of the orientation element and the second component is on a rotationally trailing side of the orientation element, the impeller being adapted to rotate in a specific rotational direction.
85. The apparatus according to clause 83 or 84 wherein the first component comprises a plate which is substantially radially oriented.
86. The apparatus according to any one of clauses 83 to 85 wherein the second component comprises an upwardly directed rotatable spindle.
87. The apparatus according to clause 86 wherein an outer surface of the spindle has longitudinal grooves.
88. The apparatus according to clause 86 or clause 87 wherein the spindle has a diameter of from 10 to 25 mm, optionally about 15 mm.
89. The apparatus according to any one of clauses 83 to 88 wherein the second component is located radially inwardly of the first component.
90. The apparatus according to clause 89 wherein a radially inner surface of the second component is located a distance of from 5 to 20 mm, optionally about 10 mm, radially inwardly of radially inner surface of the first component.
91. A method of producing potato slices for the manufacture of potato chips, the method comprising the steps of:
   a. providing a plurality of potatoes, at least some of which are elongate along a longitudinal direction;
   b. providing a cutting apparatus comprising an annular-shaped cutting head and a central impeller coaxially mounted within the cutting head for delivering potatoes radially outwardly toward the cutting head, a plurality of knives serially mounted annularly around the cutting head, each knife having a cutting edge extending substantially upwardly and spaced from the cutting head to provide a gap, extending in a radial direction, between the cutting edge and the cutting head, and a plurality of orientation elements serially and annularly mounted within the impeller to define a plurality of cutting zones located around the impeller, each cutting zone being between adjacent orientation elements;

c. feeding the potatoes into the impeller, the impeller rotating to deliver the potatoes radially outwardly toward the cutting head by a centrifugal force into the cutting zones;

d. for at least some of the elongate potatoes, deflecting a rotationally leading part of the outwardly moving elongate potato within the impeller in a rotationally rearward and inward direction by a potato deflection surface of a respective first orientation element, which potato deflection surface at least partly faces inwardly with respect to an outer periphery of the impeller, so as to orient the longitudinal direction of the elongate potato into a substantially radial orientation, in a cutting position, with the potato urged against a potato supporting surface of a second orientation element, the second orientation element being adjacent to and rotationally trailing the first orientation element; and e. cutting each potato in the cutting position into slices by the plurality of knives, centrifugal force radially outwardly advancing each potato in the cutting position prior to a subsequent slice cutting action.

92. The method according to clause 91 wherein in step c the potatoes fed to the impeller are initially uncut.

93. The method according to clause 91 or clause 92 wherein at least some of the elongate potatoes have a longitudinal length which is within the range of from 100 to 250 mm, optionally from 175 to 225 mm, and each slice has a maximum width of less than the longitudinal length of the respective potato from which it is cut, the maximum width optionally being 95 mm.

94. The method according to any one of clauses 91 to 93 wherein the potato deflection surface extends between radially inner and radially outer parts of the respective orientation element.

95. The method according to clause 94 wherein radially inner parts of adjacent orientation elements are separated in a circumferential direction to define a throat for passage therethrough of a potato in a radially outward direction toward the cutting head.

96. The method according to clause 95 wherein the throat has a width of from 70 to 150 mm, optionally from 70 to 140 mm, further optionally from 90 to 130 mm, yet further optionally from 100 to 120 mm, still further optionally from 105 to 115 mm.

97. The method according to clause 95 or clause 96 wherein the potato deflection surface is configured laterally to deflect a potato, passing through the respective throat in a radially outward direction toward the cutting head, in a deflection direction toward the adjacent orientation element defining an opposite end of the respective throat.

98. The method according to any one of clauses 91 to 97 wherein the potato deflection surface is on a first side of the orientation element and a second side of the orientation element defines a potato supporting surface.

99. The method according to clause 98 wherein the impeller is adapted to rotate in a specific rotational direction, and the first side of the orientation element is a rotationally trailing side and the second side of the orientation element is a rotationally leading side.

The invention claimed is:

1. An apparatus for cutting potato slices, the apparatus comprising:

an annular-shaped cutting head;

a central impeller;

a plurality of knives; and a plurality of orientation elements;

wherein the impeller is coaxially mounted for rotation within the cutting head for delivering potatoes radially outwardly toward the cutting head, the impeller having a base with an upper surface across which the potatoes are, in use, delivered to the cutting head;

wherein the plurality of knives is serially mounted annularly around the cutting head, each knife having a cutting edge extending upwardly and spaced from the cutting head to provide a gap, extending in a radial direction, between the cutting edge and the cutting head;

wherein the plurality of orientation elements is serially and annularly mounted within the impeller to define a plurality of cutting zones located around the impeller, each cutting zone being between adjacent orientation elements;

wherein radially inner parts of the adjacent orientation elements are separated in a circumferential direction to define between the adjacent orientation elements a throat for passage therethrough of a potato in a radially outward direction into the respective cutting zone toward the cutting head, wherein the throat providing passage into each cutting zone has a width of from 70 to 140 mm;

wherein the impeller is adapted to rotate in a specific rotational direction, wherein a first side of each of the plurality of orientation elements is a rotationally trailing side and defines a potato deflection surface, wherein a second side of each of the plurality of orientation elements is a rotationally leading side and defines a potato supporting surface; and wherein a radially inner surface of each of the plurality of orientation elements is arcuate and connects the rotationally trailing side and the rotationally leading side;

wherein, for each of the plurality of orientation elements, the orientation element is inclined at an angle of from 5 to 15 degrees to the radial direction so that a reference vector drawn from a radially inner end to a radially outer end of the orientation element is directed somewhat away from the radial direction and somewhat opposite the specific rotational direction;

wherein the potato deflection surface extends in a direction having a first component in the circumferential direction and at least a second component in the radial direction so that the potato deflection surface at least partly faces inwardly with respect to an outer periphery of the impeller; and wherein, for each of the plurality of orientation elements, a radially inner surface of the potato deflection surface is more planar than the radially inner surface of the orientation element, and wherein the radially inner surface of the potato deflection surface is inclined at an angle of from 30 to 60 degrees to the radial direction.

2. The apparatus according to claim 1 wherein each throat has a width of from 90 to 130 mm.

3. The apparatus according to claim 2 wherein each throat has a width of from 100 to 120 mm.

4. The apparatus according to claim 3 wherein each throat has a width of from 105 to 115 mm.

5. The apparatus according to claim 3 wherein each cutting zone has a maximum width, defined between radially outer ends of adjacent orientation elements, which is greater than 130 mm.

6. The apparatus according to claim 5 wherein the radially outer ends of adjacent orientation elements are separated by a distance of up to 150 mm.

7. The apparatus according to claim 6 wherein the plurality of orientation elements consists of seven orientation elements.

8. The apparatus according to claim 1 wherein each cutting zone has a maximum width, defined between radially outer ends of adjacent orientation elements, which is greater than 130 mm.

9. The apparatus according to claim 8 wherein the radially outer ends of adjacent orientation elements are separated by a distance of up to 150 mm.

10. The apparatus according to claim 1 wherein each of the plurality of orientation elements comprises a plate member which is oriented in the radial direction ±15 degrees.

11. The apparatus according to claim 1 wherein each of the plurality of orientation elements has a radial length of from 35 to 50 mm.

12. The apparatus according to claim 1 wherein the radially inner end of each of the plurality of orientation elements is located from 125 to 145 mm from a rotational axis of the impeller.

13. The apparatus according to claim 1 further comprising a motor for rotating the impeller, the motor having a rotational velocity of from 180 to 260 rpm or being adapted to rotate the impeller at an angular velocity of from 17.5 to 27.5 radians/second.

14. The apparatus according to claim 1 wherein at least one part of each of the plurality of orientation elements extends in a direction upwardly from the upper surface.

15. The apparatus according to claim 1 wherein each of the plurality of orientation elements have the same shape and dimensions.

16. The apparatus according to claim 1 wherein each of the plurality of orientation elements are equally spaced around the impeller.

17. The apparatus according to claim 1 wherein each of the plurality of orientation elements extend from 25 to 90 mm inwardly of the outer periphery of the impeller.

18. The apparatus according to claim 1 wherein the radially inner part of each of the plurality of orientation elements is located from 35 to 60 mm inwardly of the outer periphery of the impeller.

19. The apparatus according to claim 1 wherein the plurality of orientation elements consists of seven orientation elements, and each throat has a width of from 100 to 120 mm.

20. The apparatus according to claim 1 wherein the plurality of orientation elements consists of six orientation elements, and each throat has a width of from 120 to 140 mm.

21. The apparatus according to claim 1 wherein the potato deflection surface is configured laterally to deflect a potato, passing through a respective throat in a radially outward direction toward the cutting head, in a deflection direction toward an adjacent orientation element defining an opposite end of the respective throat.

22. The apparatus according to claim 1 wherein each of the plurality of orientation elements comprises a plate member, which is substantially radially oriented.

* * * * *